US006085563A

United States Patent [19]

Heiberger et al.

[11] Patent Number: 6,085,563

[45] Date of Patent: Jul. 11, 2000

[54] METHOD AND APPARATUS FOR CLOSELY COUPLING MACHINES USED FOR CAN MAKING

[75] Inventors: Joseph M. Heiberger; Anton A. Aschberger, both of Downers Grove; Floyd Arnold Jones, Wheaton, all of Ill.

[73] Assignee: Crown Cork & Seal Technologies Corporation, Alsip, Ill.

[21] Appl. No.: 09/177,036

[22] Filed: Oct. 22, 1998

[51] Int. Cl.[7] ..... B21D 43/02

[52] U.S. Cl. ..... 72/94; 413/69; 72/405.03

[58] Field of Search ..... 72/94, 405.03; 413/69; 198/608

[56] References Cited

U.S. PATENT DOCUMENTS

| | | | |
|---|---|---|---|
| 3,586,175 | 6/1971 | Gauld | 214/1 |
| 3,983,729 | 10/1976 | Traczyk et al. | 72/43 |
| 4,003,324 | 1/1977 | Tate et al. | 113/7 R |
| 4,272,977 | 6/1981 | Gombas | 72/121 |
| 4,513,595 | 4/1985 | Cvacho | 413/69 |
| 4,519,232 | 5/1985 | Traczyk et al. | 72/133 |
| 4,557,167 | 12/1985 | Cvacho | 82/47 |
| 4,760,725 | 8/1988 | Halasz | 72/84 |
| 4,774,839 | 10/1988 | Caleffi et al. | 72/354 |
| 5,148,742 | 9/1992 | Stirbis et al. | 101/40 |
| 5,231,926 | 8/1993 | Williams et al. | 101/40 |
| 5,349,837 | 9/1994 | Halasz et al. | 72/94 |
| 5,433,098 | 7/1995 | Bowlin et al. | 72/117 |
| 5,467,628 | 11/1995 | Bowlin et al. | 72/126 |
| 5,611,231 | 3/1997 | Marritt et al. | 72/94 |
| 5,755,130 | 5/1998 | Tung et al. | 72/60 |

FOREIGN PATENT DOCUMENTS 0 570 005 A2 11/1993 European Pat. Off. .

*Primary Examiner*—Lowell A. Larson
*Attorney, Agent, or Firm*—Woodcock Washburn Kurtz Mackiewicz & Norris LLP

[57] ABSTRACT

A system for performing sequential operations on a can body, such as necking the open end of the can body, in which two or more machines, such as die necking machines are, are coupled by a transfer module. The transfer module comprises a multi-pocket wheel that receives can bodies from a multi-pocket discharge wheel of the first necking machine and discharges them to a multi-pocket input wheel of the second die necking machine. The drive motor of one of the necking machines is eliminated, while the drive motor on the other machine is enlarged. A gear on the transfer module couples the gear trains on the first and second necking machines into a common gear train. Thus, the transfer module gear train transfers power from the necking machine having the enlarged drive motor to the necking machine for which the drive motor was eliminated. This enables a single drive motor to entire drive train for both machines.

2 Claims, 8 Drawing Sheets

METHOD AND APPARATUS FOR CLOSELY COUPLING MACHINES USED FOR CAN MAKING

FIELD OF THE INVENTION

The current invention is directed to a method and apparatus for closely coupling machines, such as multi-stage necking machines, used to perform successive operations on cans.

BACKGROUND OF THE INVENTION

Two piece cans are conventionally used to package beverages, such as beer and carbonated soft drinks. Such cans are often made from aluminum and are formed by attaching a circular lid to a generally cylindrical can body formed by a drawing and ironing process. Typically, the diameter of the open end of the can body is reduced prior to attaching the lid in order to enable reducing the diameter of the lid. The reduction in the diameter of the can end is accomplished in a series of operations referred to as "necking."

In order to avoid wrinkling or otherwise undesirably distorting the can end, necking is performed in a number of incremental steps, with the diameter of the open end being reduced only slightly in each step. FIG. 1 shows the open end 3 of a can body 2 as it undergoes successive necking operations. Although, for simplicity, only three discrete necking operations are shown in FIG. 1, it should be appreciated that a larger number necking operations will frequently be utilized. A variety of methods have been employed to perform the necking operation. In one approach, referred to as die necking and disclosed in U.S. Pat. No. 5,755,130 (Tung et al.); U.S. Pat. No. 4,519,232 (Traczyk et al.) and U.S. Pat. No. 4,774,839 (Caleffi et al.), each of which is hereby incorporated by reference in its entirety, the open end of the can body is forced into a die having an inwardly tapered surface that permanently deforms the metal inward. Another approach, referred to as "spin necking," involves reducing the can end diameter by pressing the can end against a rotating tool.

A variety of machines have been developed for necking can ends. One such machine 6, which employs a die necking process, is shown in FIGS. 2–5. Such machines are available from Belvac Production Machinery of Lynchburg, Va., as model 595 6N/8. As shown best in FIGS. 1 and 2, such machines typically comprise a plurality of modules, designated 11, 17, 19, and 21, attached to a unitary base 5. An input chute 8 directs the can bodies 2 to an input module 11—specifically, to one of the pockets of a multi-pocket input feed wheel 10 that forms a portion of the input module. The input feed wheel 10 is constructed similar to the intermediate wheels 18, discussed below, except that its pockets have a saw tooth geometry that aids in picking cans from the input chute 8. The input feed wheel 10 carries the can body counterclockwise, when viewed from the front, approximately and deposits it into a first necking module 17—specifically, into one of the pockets of a multi-pocket rotary necking station 16 that forms a portion of the necking module.

Using techniques well known in the art, in the necking station 16, the open end of the can body 2 is brought into contact with a die so as to reduce its diameter slightly, as previously discussed. The rotary necking station 16 carries the partially necked can body clockwise and deposits it into a first intermediate module 19—specifically to one of the pockets of a multi-pocket intermediate wheel 18 that forms a portion of the intermediate module. As discussed further below, the intermediate wheel 18 carries the can body counterclockwise and deposits it into one of the pockets of the next multi-pocket rotary necking station 16, which further reduces the diameter of the can end. Thus, a intermediate wheel 18 is disposed between each pair of necking stations 16 and carries the can body from the each necking station to the next down stream necking station. The necking process is repeated in each necking station 16 of the machine 2 so as to gradually reduce the diameter of the can end 3. As many as nine necking stations 16 may be incorporated into a single machine 2.

As shown in FIG. 3, each intermediate module 19 comprises a base plate 64 that supports a bearing housing 60 and rear support plate 62 that, in turn, support the drive shaft 32 for the intermediate module. The drive shaft 32 is driven by a gear 24, affixed to its rear end, as discussed further below. The shaft 32 has a hub 90 at its front end that supports the intermediate wheel 18. As previously discussed, the intermediate wheel 18 has a plurality of pockets 56 formed on its rim 94. Circumferentially extending front and rear stationary plates 92 and 93, respectively, project outward from the hub 90 and extend to just below the rotating rim 94 so as to form an annular passage 95. A pair of baffles (not shown) divide the annular passage into upper and lower halves 95' and 95", respectively.

Piping 88 conveys suction 99 from a vacuum source 84 to a valve 86.

A manifold 87 directs the suction from the valve 86 to the lower portion 95" of the annular passage via openings 97 in the lower half of plate 93. From the lower portion 95" of the annular passage, the suction 99 is directed to each of the pockets 56 in the lower half of the wheel 18 via the vacuum ports 58. The upper portion 95' of the annular passage is vented to atmosphere via an opening 96 in the upper half of plate 93. Thus, suction 99 is applied to the pockets 56 as they rotate counterclockwise past the lower portion 95" of the annular passage and is released as they rotate past the upper portion 95' of the annular passage—that is, suction is applied to each of the pockets 56 from about the 3 o'clock location, at which time the they receive a can body 2 from the upstream necking module 17, to about the 9 o'clock location, at which time they discharge the can body to the downstream necking module.

A set of upper and lower guide plates 66 and 70, respectively, are located in front of the intermediate wheel 18. In addition, another set of upper and lower guide plates 68 and 72 are located behind the transfer wheel. The guide plates are supported from a bracket 78 by spacers 74, 76, 80 and 82. The guide plates ensure that the can bodies maintain their position along the flow path formed by the intermediate module 18.

Returning to FIG. 2, the last necking module 16 deposits the can body 2 to a discharge module 21—specifically to one of the pockets in a discharge wheel 20 that forms a portion of the discharge module. The discharge wheel 20, which is constructed similar to the intermediate wheels 18, carries the can body counterclockwise and deposits it into a discharge chute 22. Although the can body 2 is carried circumferentionally by the wheels 10, 18 and 20 and necking stations 16, the general flow path of the can body through the machine is along a linear, horizontally oriented path from left to right as viewed in FIG. 2.

The input feed module 10 and the discharge module 21 each employ a suction system for retaining and releasing can bodies of the type describe above with reference to the intermediate module 19.

As shown in FIGS. 4 and 5, the input feed wheel 10, intermediate wheels 18, and discharge wheel 20 are each driven by a shaft 31 that is, in turn, driven by a gear 24. The necking stations 16 are also driven by a shaft 34 driven by a gear 24. The gears 24 are indexed and meshed so that the pockets of one component are in registration with the pockets of the adjacent components. One of the gears 24' is driven through a gear box 26 by a motor 28 using a belt drive 30. The gear 24' then drives the two immediately adjacent gears 24, which, in turn, drive the next gears, and so on. Thus, the gear train for the necking machine comprises a row of gears each of which engages the adjacent gear. As shown in FIGS. 4 and 5, the gear 24' that is driven directly the gear box is part of the intermediate module 19' is located in the center of the machine.

In order to fully neck the can body 2, it is generally necessary to perform more than the eight or nine necking operations available in conventional necking machines of the type shown in FIGS. 2–5. In the past, additional necking operations were performed by connecting two necking machines via a conveyor 40, as shown in FIG. 6, so that the second machine was downstream of the first machine and received partially necked can bodies from the first machine. The second machine then performed further necking operations on the can end.

Unfortunately, use of the conveyor 40 to couple the necking machines 6 has several drawbacks, including damage to the cans during conveyance and jamming of the cans in the conveyor, which requires a stoppage of the machines.

Also, since the conveyor mixes the can from each necker, all of the components must be checked when a problem is detected in a can from one of the neckers.

Consequently, it would be desirable to provide a method and apparatus for reliably transferring can bodies between two machines that perform operations sequentially on can bodies.

SUMMARY OF THE INVENTION

It is an object of the current invention to provide a method and apparatus for reliably transferring can bodies between two machines that perform operations sequentially on can bodies. This and other objects is accomplished in a system for successively performing operations on a can in a plurality of discrete steps, comprising a first machine for performing a first portion of the operations on the can and a second machine for performing a second portion of the operations.

The first machine comprises first rotating means for performing at least one of the operations on the can, such as necking operations, so as to produce a partially operated upon can, and a first gear train driving the first rotating operation performing means. The first machine may also comprise an input feed wheel and a discharge wheel. The first gear train preferably includes a first gear that drives the discharge wheel of the first machine.

The second machine comprises second rotating means for performing at least a second of the operations on the can, such as an additional necking operation, so as to produce a further operated upon can, and a second gear train driving the second rotating operation performing means. The second machine may also comprise an input feed wheel and a discharge wheel. The second gear train preferably includes a second gear that drives the input wheel of the second machine.

The system also includes a transfer means for (i) transferring the partially operated upon can from the first machine to the second machine, (ii) transferring power between the first and second gear trains, and (iii) synchronizing the operation of the first and second rotating operating performing means. The transfer means preferably includes a transfer wheel and a third gear. The transfer wheel is located to receive the partially operated upon can from the discharge wheel of the first machine and to deliver the can to the input feed wheel of the second machine. The transfer wheel is driven by the third gear, while the third gear drives one of the first and second gears and is driven by the other one of the first and second gears.

DESCRIPTION OF THE PREFERRED EMBODIMENT

Figure 7:
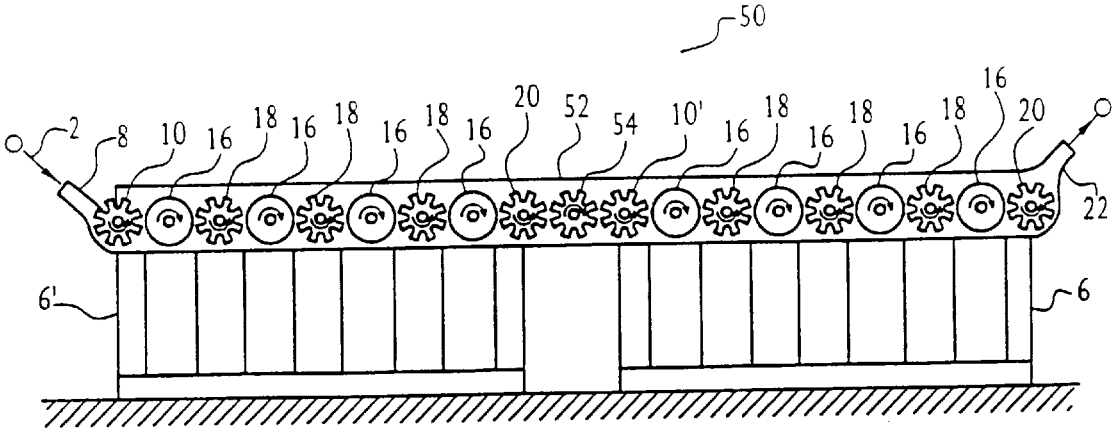
FIG. 7 is a front view, partially schematic, of a system for necking can ends employing two necking machines closely coupled by a transition module according to the current invention.
Figure 8:
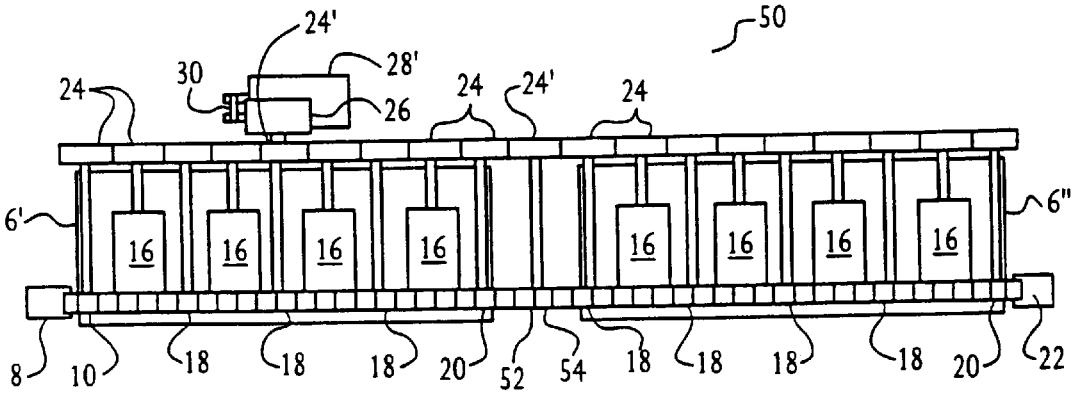
FIG. 8 is a top view, partially schematic, of the necking system shown in FIG. 7 according to the current invention.
Figure 9:
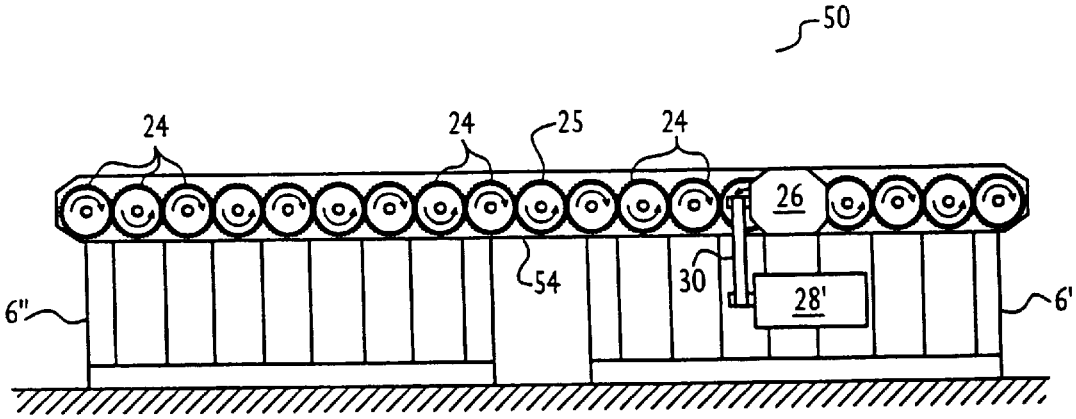
FIG. 9 is a rear view, partially schematic, of the necking system shown in FIGS. 7 and 8 according to the current invention.
Figure 10:
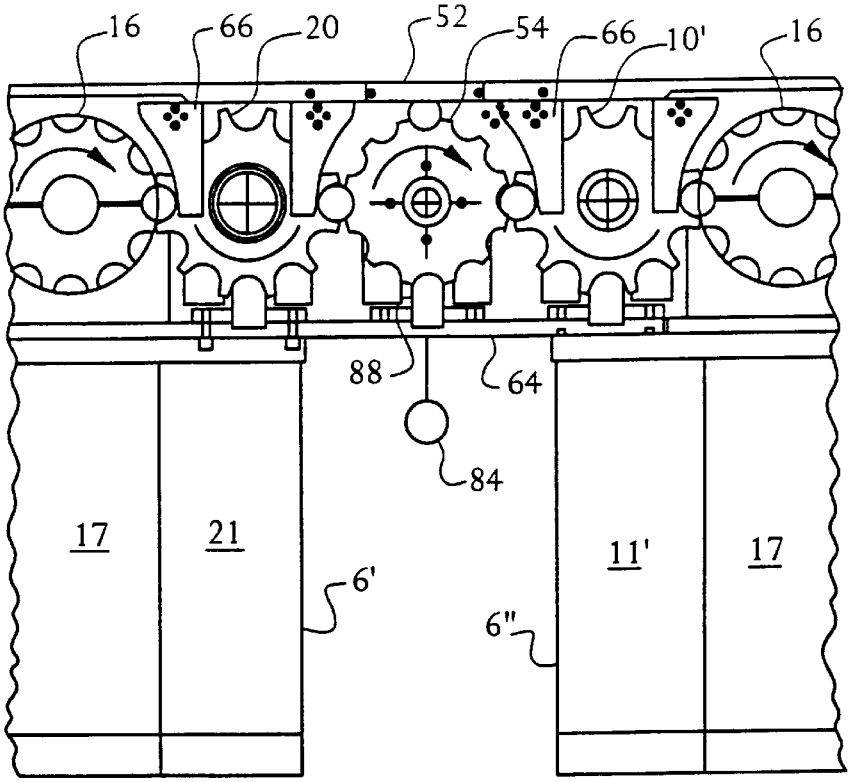
FIG. 10 is a detailed front view of the necking system shown in FIG. 7 in the vicinity of the transition module according to the current invention, with some of the guide plates removed for clarity.

A system 50 for necking can ends according to the current invention is shown in FIGS. 7–9. The system 50 comprises upstream and downstream necking machines 6' and 6" that are substantially the same as the necking machine 6 described above except for certain modifications discussed below. According to the current invention, the necking machines 6' and 6" are directly and closely coupled by a transfer module 52. As discussed in detail below, the transfer module 52 (i) transfers partially necked can bodies 2 from the first machine 6' to the second machine 6" for completion of the necking operation, (ii) transfers power from the gear train of one machine to the gear train of the other machine, and (iii) synchronizes the rotation of the two machines.

For simplicity, each of the necking machines 6' and 6" shown in FIGS. 7–9 has been depicted as having four necking stations 16. However, the necking machines 6' and 6" will often have more than four necking stations 16 and, in fact, as previously discussed, according to current practice, as many as nine necking stations may be incorporated into each necking machine.

As shown in FIGS. 7–10, the first necking machine 6' has been modified by (i) removing the discharge chute 22, and (ii) replacing the motor 28 with a larger motor 28'. The second necking machine 6" has been modified by (i) replacing the input feed wheel 10 with an input feed wheel 10', which is substantially identical to the intermediate wheel 18, and (ii) eliminating the motor 28, gear box 26 and associated components. In addition, any piping or electrical conduits in the area to be occupied by the transfer module 52 must be relocated.

Figure 13:
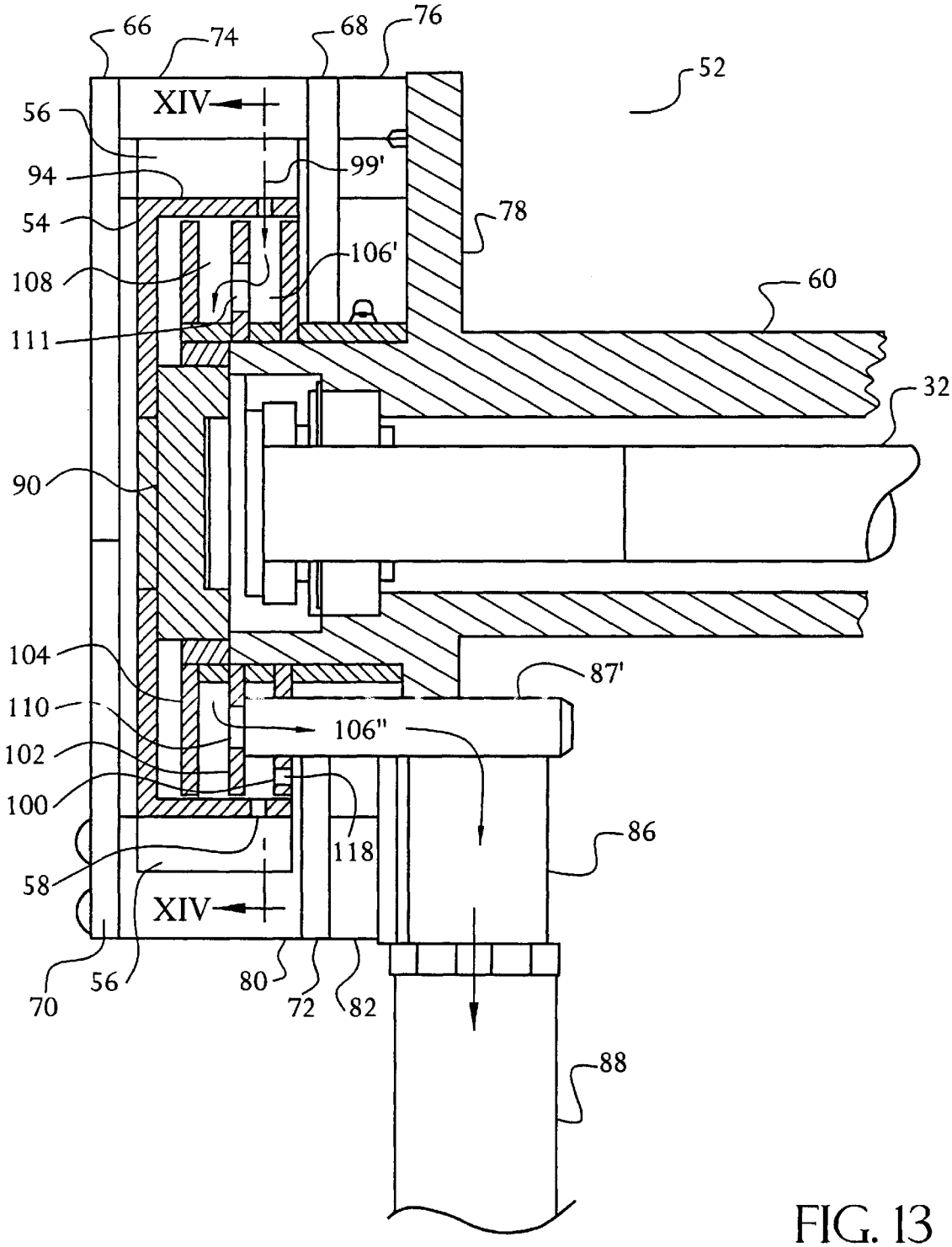
FIG. 13 is a longitudinal cross-section through the transition module shown in FIGS. 7–12 taken along line XIII—XIII shown in FIG. 12.

The structure of transfer module 52 is similar to that of the intermediate modules 18, discussed above, except for certain important differences, discussed immediately below. As shown best in FIGS. 13 and 14, three circumferentially extending stationary plates—a rear plate 100, a front plate 104, and an intermediate plate 102—extend from the hub 90 to just below the periphery 94 of a rotary transfer wheel 54. The rear and intermediate plates 100 and 102, respectively, form a rear annular chamber 106 that is in flow communication with the vacuum ports 58 formed in the pockets 56.

Baffles 112 and 114 extending between the rear and intermediate plates 100 and 102 divide the rear annular chamber 106 into upper and lower halves 106' and 106", respectively. The intermediate and front plates 102 and 104, respectively, form a front annular chamber 108. Openings 111 in the upper portion of intermediate plate 102 place the upper portion 106' of the rear annular chamber into flow communication with the front annular chamber 108. An opening 110 in the lower portion of the intermediate plate 102 places the front annular chamber 108 into flow communication with the vacuum manifold 87', which extends through the lower portion 106" of the rear annular passage. Thus, the front annular chamber 108 serves as a passage between the upper portion 106' of the rear annular chamber and the vacuum manifold 87. An opening 118 in the rear plate 100 vents the lower portion 106" of the rear annular chamber to atmosphere.

Figure 1:
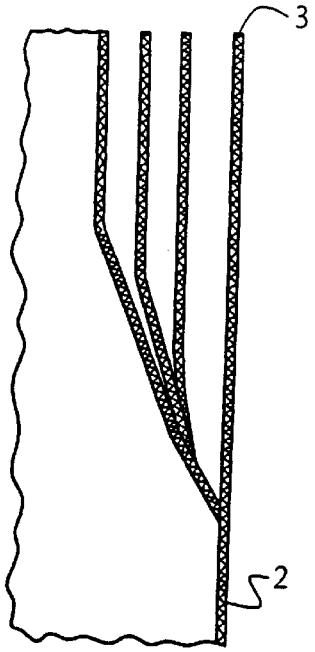
FIG. 1 PRIOR ART
FIG. 1 is a schematic view of the open end of a can after each successive necking operation according to the prior art.
Figure 14:
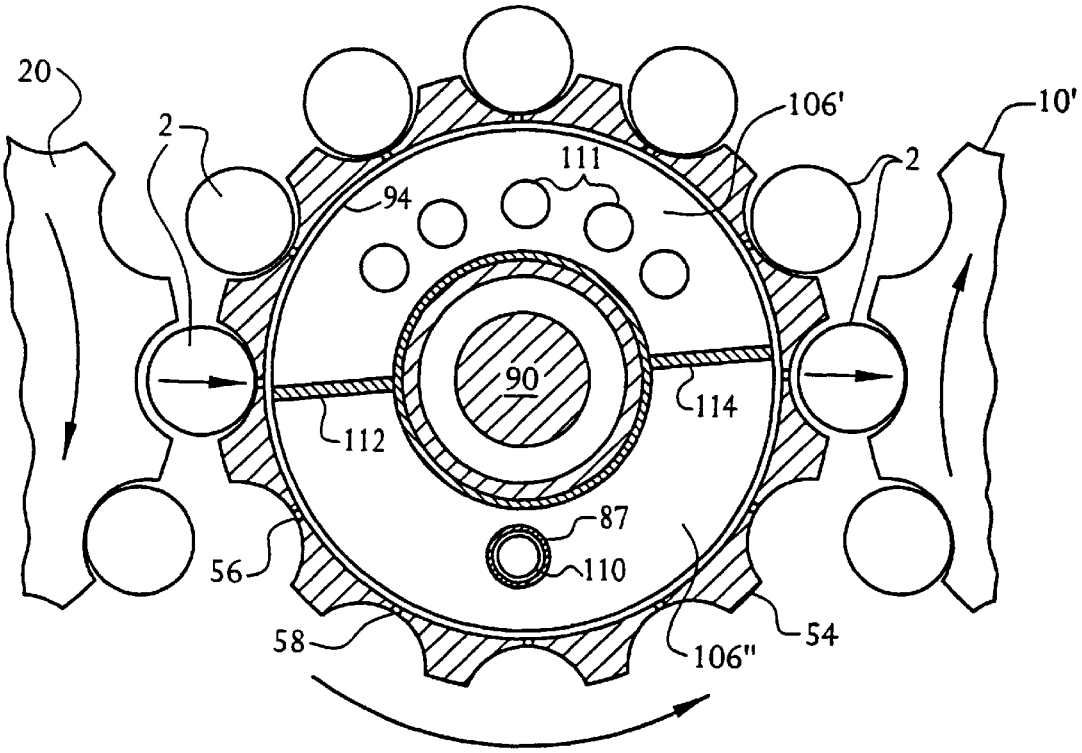
FIG. 14 is a transverse cross-section through the transition module shown in FIGS. 7–13 taken along line XIV—XIV shown in FIG. 13.
Figure 2:
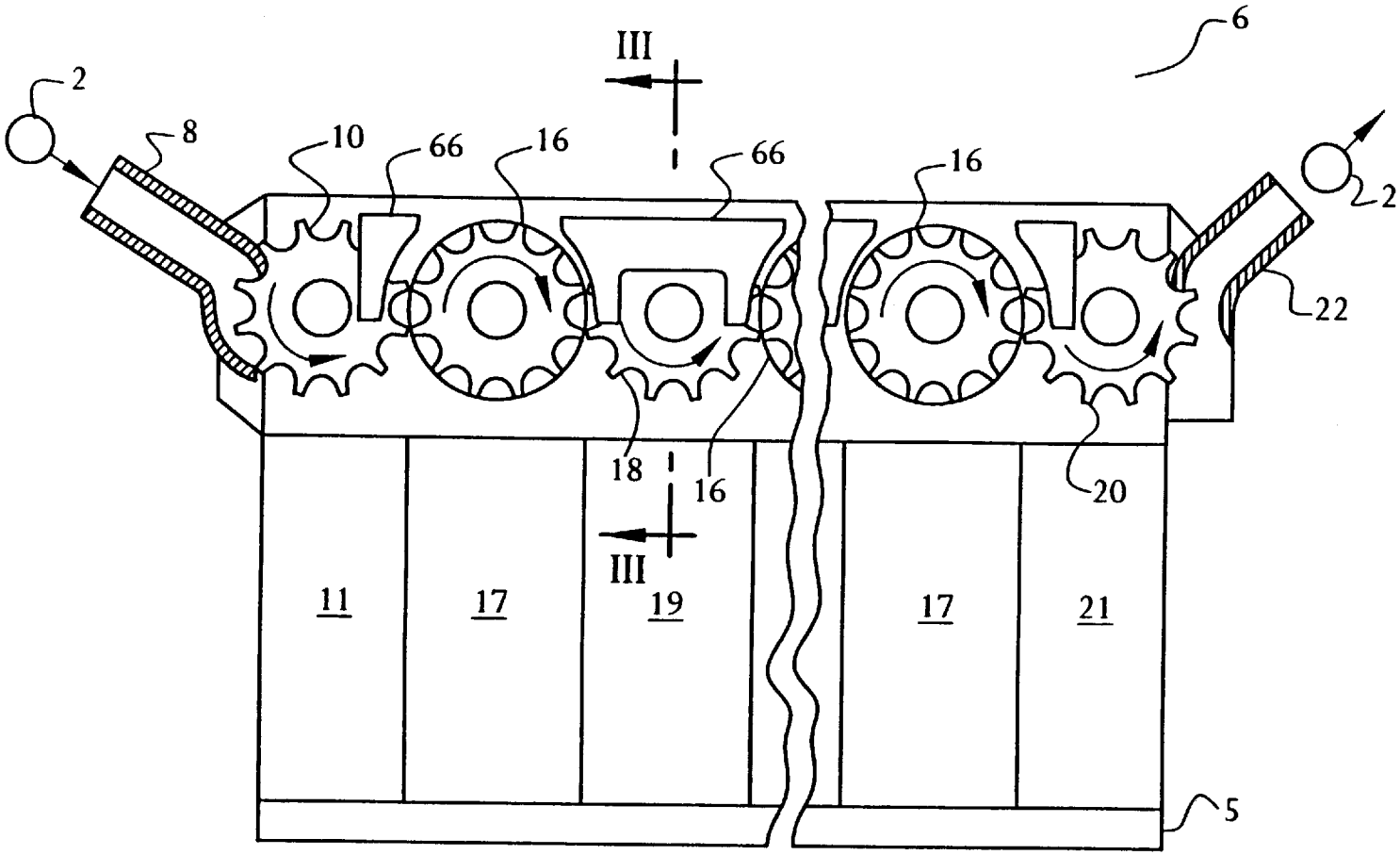
FIG. 2 PRIOR ART
FIG. 2 is a front view of a machine for necking can ends according to the prior art, with some of the guide plates removed for clarity.
Figure 3:
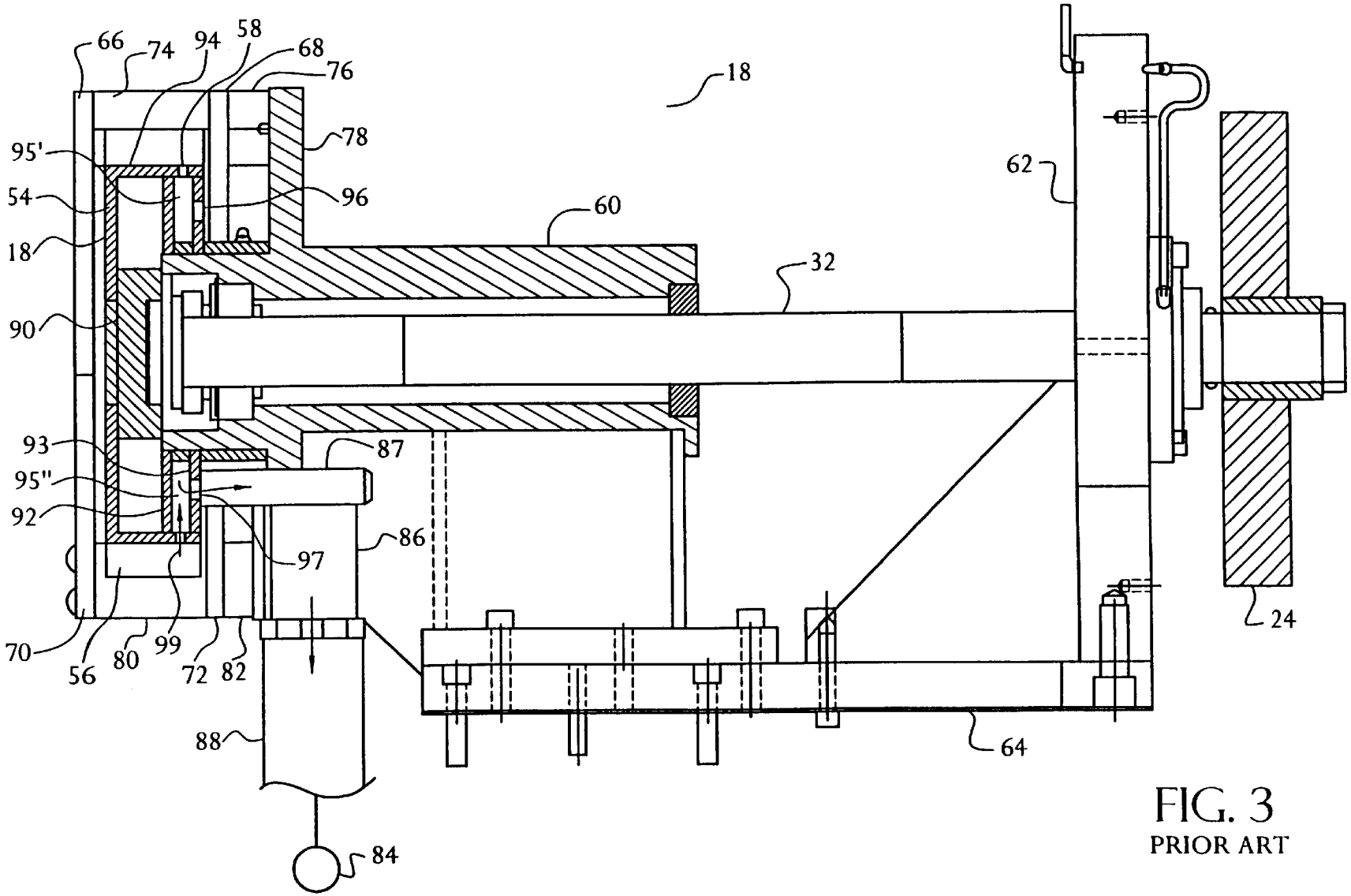
FIG. 3 PRIOR ART
FIG. 3 is a longitudinal cross-section through the intermediate module shown in FIG. 2 taken along line III—III shown in FIG. 2.
Figure 5:
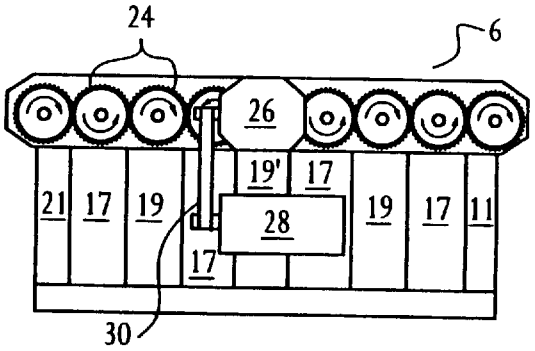
FIG. 5 PRIOR ART
FIG. 5 is a rear view, partially schematic, of the necking machine shown in FIG. 2 according to the prior art.
Figure 4:
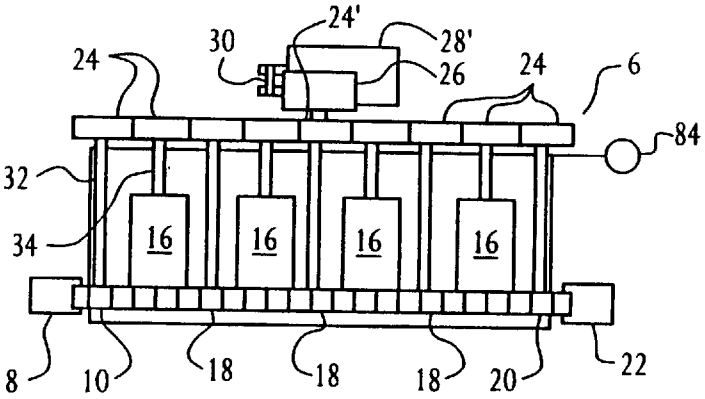
FIG. 4 PRIOR ART
FIG. 4 is a top view, partially schematic, of the necking machine shown in FIG. 2 according to the prior art.
Figure 6:
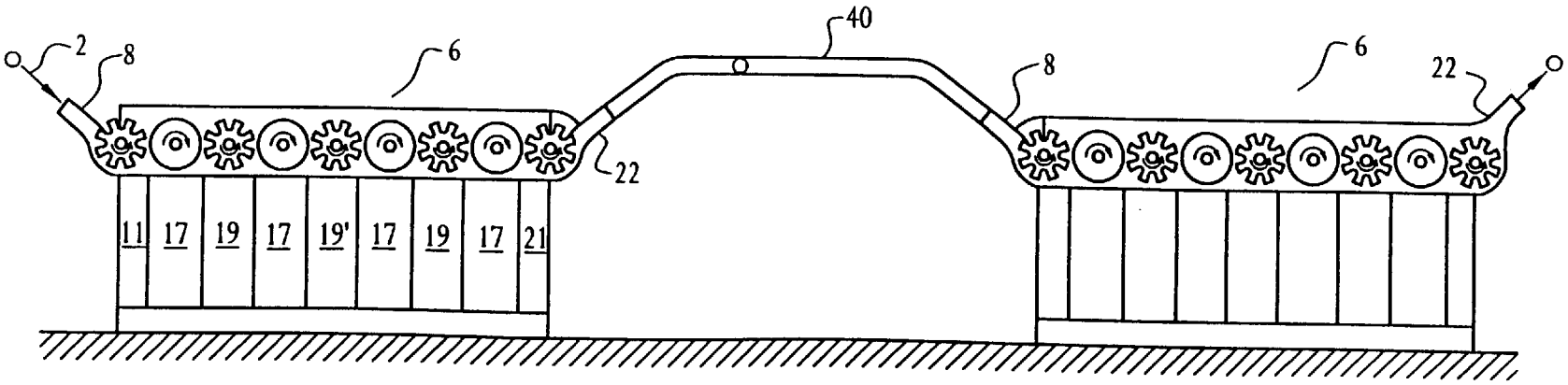
FIG. 6 PRIOR ART
FIG. 6 is a front view, partially schematic, of a system for necking can ends, as shown in FIG. 1, employing two necking machines of the type shown in FIGS. 2–5 that are connected by a conveyor according to the prior art.

As shown best in FIG. 14, in operation, the transfer wheel 54 -which rotates in an opposite direction from the intermediate wheels 18, the input feed wheels 10, 10' and discharge wheel 20—receives partially necked can bodies 2 from the pockets of the discharge wheel 20 of the upstream necking machine 6' and delivers them into the pockets of the input feed wheel 10' of the downstream necking machine 6". Specifically, as the transfer wheel 54 rotates clockwise, the pockets 56 are successively conveyed past the baffle 112 from the lower portion 106" of the rear annular chamber to the upper portion 106'. When this happens, a suction 99' is applied to the pockets 56 via a flow path formed between the holes 58 in the rim 94 and the vacuum manifold 87'. This flow path is formed by the upper portion 106' of the rear annular chamber, the holes 110 and 111 in the intermediate plate 102, and the front annular chamber 108.

When the pockets 56 rotate sufficiently far to pass the baffle 114 and reach the lower portion 106" of the rear annular chamber, which is vented to atmosphere, the suction 99' is released. Thus, suction 99' is applied to the pockets 56 as they rotate past the upper portion of the transfer module 52 and is released as they rotate past the lower portion—that is, suction is applied to each of the pockets 56 from about the 9 o'clock location, at which time the they receive a can body 2 from the upstream discharge module 20, to about the 2:30 o'clock location, at which time they discharge the can body to the input wheel 10' of the downstream necking module.

Figure 11:
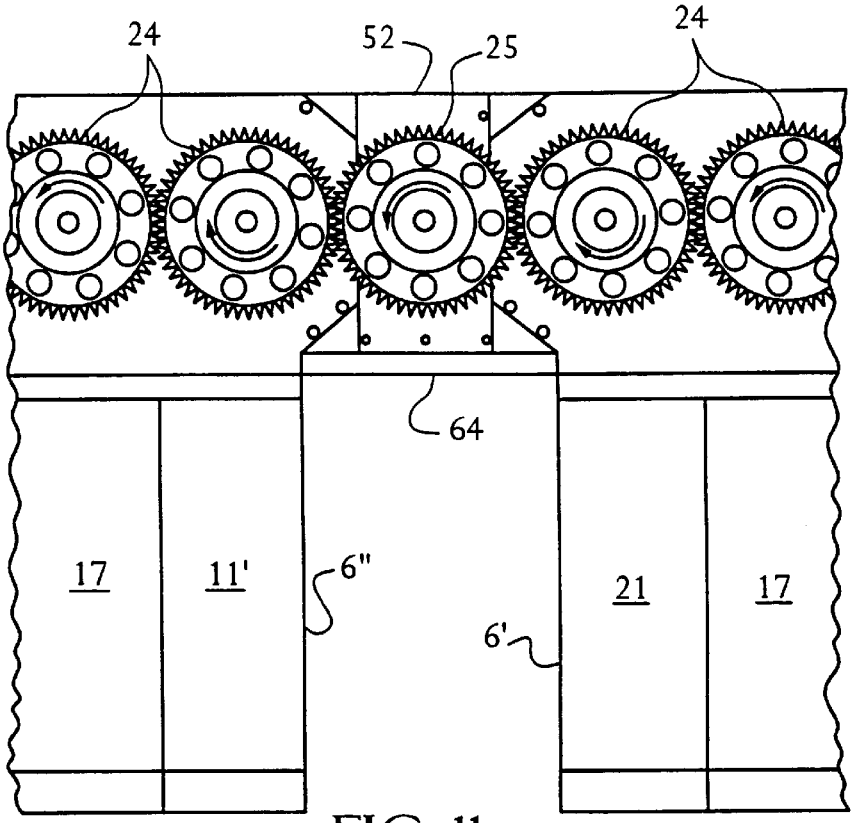
FIG. 11 is a detailed rear view of the necking system shown in FIG. 7 in the vicinity of the transition module according to the current invention.
Figure 12:
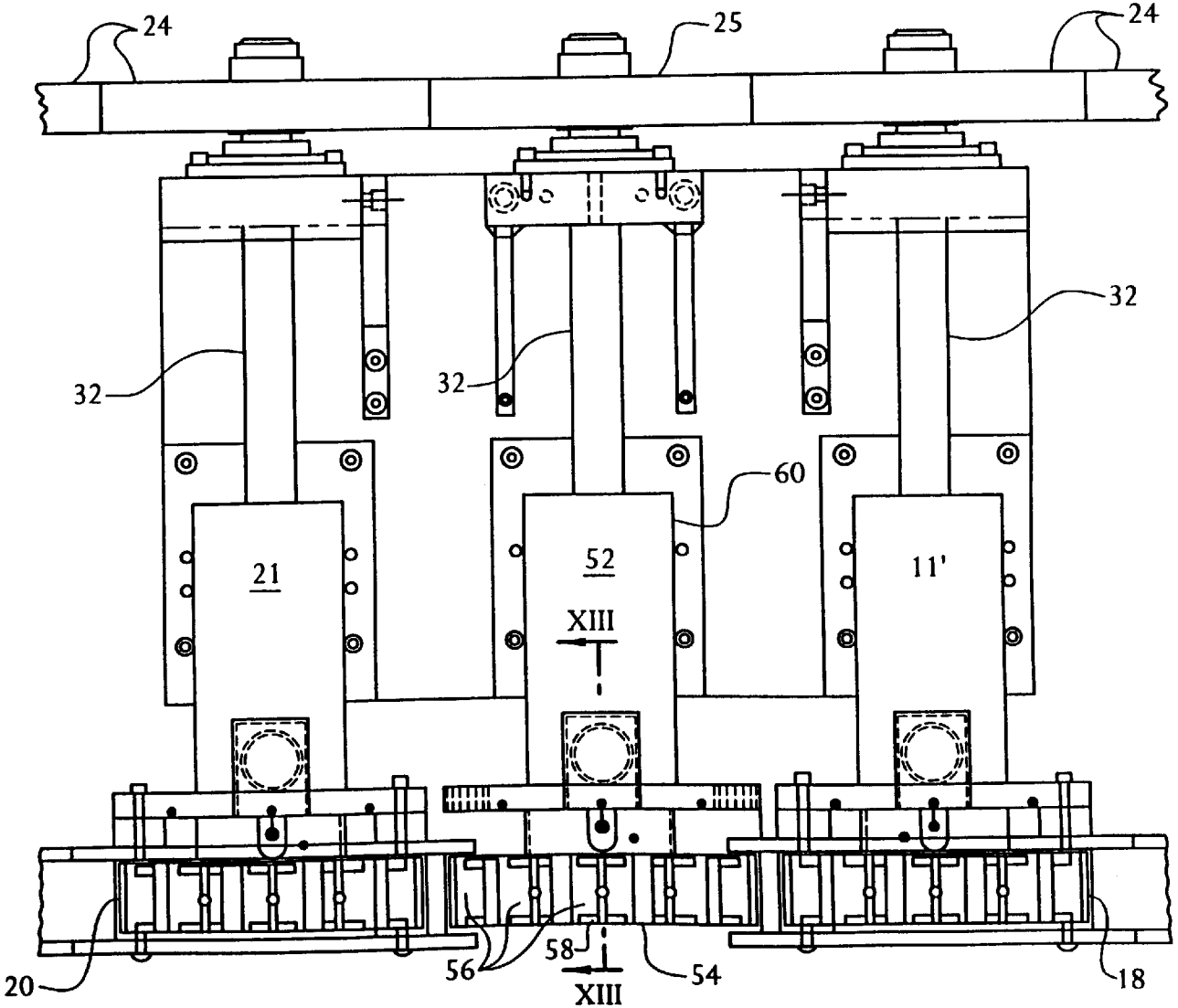
FIG. 12 is a detailed top view of the necking system shown in FIG. 7 in the vicinity of the transition module according to the current invention.

As shown in FIG. 12, a gear 25 is formed on the shaft 32 of the transfer module 52 and drives the rotation of the transfer wheel 54. As shown in FIGS. 9, 11 and 12, the transfer module drive gear 25 meshes with and is indexed with the gear 24 for the discharge module 21 of the upstream necking machine 6' as well as the gear 24 for the feed module 11' of the down stream necking machine 6". Thus, the gear 25 serves to synchronize the two machines—causing the two machines to operate at the same speed and the pockets 56 of the transfer wheel 54 to be in registration with the pockets of both the discharge wheel 20 of the upstream machine 6' and the input feed wheel 10' of downstream machine 6", for example, by aligning timing marks when the module 54 is coupled to the two necking machines.

As previously discussed, according to the current invention, the motor and gear box for one of the necking machines is eliminated when the machines are coupled. Although as shown in the drawings, the motor and gear box for second necking machine 6" has been eliminated, the invention could be practiced by eliminating the motor and gear box for the first necking machine 6' instead. In any event, according to the current invention, both necking machines 6' and 6" are driven by a single motor 28' that is, preferably, of larger capacity that the motor 28 conventionally used. As shown best in FIGS. 8 and 11, the drive gear 25 for the transfer module 52 essentially integrates the gear trains of the two machines into a common gear train driven by a single motor 28' and gear box 26'. Although as shown in FIG. 8, the motor 28' drives the gear 24' for the central intermediate module 17 of the first necking machine 6', it could be connected so as to drive any of the other gears 24, 25 within the common gear train.

The incorporation of the drive gear 25 for the transfer module 52 into the gear train for the machines 6' and 6" according to the current invention allows the transfer module to not only transfer can bodies between the two necking machines, but also to both transfer power from one machine to the other and synchronize one machine to the other. This arrangement allows precise timing of the two machines to ensure proper registration of the pockets and a smooth and continuous flow of can bodies through the system.

Thus, a succession of necking operations greater than that permitted on a single necking machine can be performed, without the drawbacks associated with the use of conventional conveyor systems, by closely and directly coupling two necking machines according to the current invention. Coupling two necking machines of type discussed above permits a total of as many as eighteen or more successive necking operations to be preformed on the can bodies. In the event that a somewhat lesser number of necking operations are required—for example, twelve operations—some of the necking stations 16 in one or both of the machines 6' and 6" could be replaced by conventional intermediate modules 17, as is well known in the prior art.

Many variations in the invention described above will be apparent to one skilled in the art armed with the teachings of the current invention. For example, although the invention has been described with reference to coupling necking machines, each of which comprises a number of modules attached to a unitary base 5, the invention could also be practiced by coupling two or more necking machines one or both of which was comprised of a number of discrete modules, each having its own base and joined together into a single machine.

Moreover, although the invention has been described with reference to coupling two complete, existing necking machines, the invention could also be practiced by coupling one or more discrete necking modules to an existing necking machine. Further, although the invention has been described in detail with reference to coupling multi-stage die necking machines, the invention could also be practiced by coupling multi-stage spin necking machines or other machines that sequentially operate on a can body, such as flanging machines. The invention could also be practiced by coupling two machines that perform different types of operations on the can, such as a necking machine and a flanging machine. Moreover, although the invention has been described by reference to coupling two machines together, the invention could also be practiced by coupling three or more machines together in sequential fashion. Consequently, the present invention may be embodied in other specific forms without departing from the spirit or essential attributes thereof and, accordingly, reference should be made to the appended claims, rather than to the foregoing specification, as indicating the scope of the invention.

What is claimed:

1. A method for directly coupling first and second necking machines for successively reducing the diameter of the end of a can in a plurality of discrete operations, said first necking machine comprising (i) a plurality of first necking modules for partially reducing said diameter of said can end, (ii) a discharge wheel for discharging said partially necked can, (iii) a first motor and (iv) a first gear train driven by said first motor, said first gear train comprising a first gear driving said discharge wheel, said second necking machine comprising (i) an input feed wheel for receiving said partially necked can, (ii) a plurality of second necking modules for further reducing said diameter of said can end, (iii) a second motor, and (iv) a second gear train driven by said second motor, said second gear train comprising a second gear driving said input feed wheel, said coupling method comprising the steps of:

a) installing a transfer wheel between said discharge wheel of said first necking machine and said input feed wheel of said second necking machine so that said transfer wheel receives said partially necked cans from said discharge wheel and delivers said cans to said input feed wheel;

b) installing a third gear so as to mesh with said first and second gears, said third gear driving said transfer wheel, whereby one of said first and second gear trains drives the other of said gear trains; and c) eliminating at least one of said motors so that only one motor drives said first and second gear trains, whereby said one motor drives one of said first and second gear trains which drives said third gear which drives the other of said gear trains.

2. A method for directly coupling first and second machines for successively performing operations on a can in a plurality of discrete operations, said first machine comprising (i) a plurality of first modules for performing at least a first operation on said can so as to produce a partially operated upon can, (ii) a discharge wheel for discharging said partially operated upon can, (iii) a first motor, and (iv) a first gear train driven by said first motor, said first gear train comprising a first gear driving said discharge wheel, said second machine comprising (i) an input feed wheel for receiving said partially operated upon can, (ii) a plurality of second modules for performing at least a second operation on said can, (iii) a second motor, and (iv) a second gear train driven by said second motor, said second gear train comprising a second gear driving said input feed wheel, said coupling method comprising the steps of:

a) installing a transfer wheel between said discharge wheel of said first machine and said input feed wheel of said second machine so that said transfer wheel receives said partially operated upon cans from said discharge wheel and delivers said cans to said input feed wheel;

b) installing a third gear so as to mesh with said first and second gears, said third gear driving said transfer wheel, whereby one of said first and second gear trains drives the other of said gear trains; and c) eliminating at least one of said motors so that only one motor drives said first and second gear trains whereby said one motor drives one of said first and second gear trains which drives said third gear which drives the other of said gear trains.

* * * * *